United States Patent [19]

Etoh et al.

[11] Patent Number: 4,881,510

[45] Date of Patent: Nov. 21, 1989

[54] BREATHER DEVICE OF AN ENGINE

[75] Inventors: Motoaki Etoh; Keisuke Ishii, both of Tokyo, Japan

[73] Assignee: Fuji Jukogyo Kabushiki Kaisha, Tokyo, Japan

[21] Appl. No.: 276,577

[22] Filed: Nov. 28, 1988

[30] Foreign Application Priority Data

Dec. 21, 1987 [JP] Japan ..... 62-194659[U]

[51] Int. Cl.[4] ..... F01M 9/10; F02M 25/06

[52] U.S. Cl. ..... 123/572; 123/196 W

[58] Field of Search ..... 123/572, 573, 574, 196 W, 123/41.86

[56] References Cited

U.S. PATENT DOCUMENTS

| | | | |
|---|---|---|---|
| 4,502,424 | 3/1985 | Katoh et al. | 123/572 |
| 4,513,702 | 4/1985 | Koga et al. | 123/196 W |
| 4,597,372 | 7/1986 | Furukawa | 123/572 |
| 4,601,267 | 7/1986 | Kronich | 123/572 |
| 4,603,673 | 8/1986 | Hiraoka et al. | 123/572 |
| 4,607,604 | 8/1986 | Kanoh et al. | 123/572 |
| 4,825,825 | 5/1989 | Chino et al. | 123/196 W |

*Primary Examiner*—Willis R. Wolfe

*Assistant Examiner*—M. Macy

*Attorney, Agent, or Firm*—Beveridge, DeGrandi & Weilacher

[57] ABSTRACT

A breather device of an engine comprises a pressure chamber communicating with the crank chamber of the engine, an oil sump chamber communicating via a pressure-responsive valve with said pressure chamber, a breather chamber communicating via an oil holding wall with said oil sump chamber and communicating also with the engine air intake system, and oil return passage means having a downstream end submerged in oil in an oil pan, said oil sump chamber being communicative with the oil return passage means. Positive pressure in the crank chamber causes blow-bye gas wherein to flow via the pressure chamber and the pressure-responsive valve into the oil sump chamber, then to detour over the oil holding wall into the breather chamber, and then to flow into the air intake system, while lubricating oil contained in the blow-bye gas in the crank chamber is separated from the blow-bye gas in the pressure chamber, the pressure-responsive valve, and the oil sump chamber, and oil retained in the oil sump chamber is circulated back through the oil return passage means to the oil pan.

2 Claims, 4 Drawing Sheets

BREATHER DEVICE OF AN ENGINE

BACKGROUND OF THE INVENTION

1. Field of the Art

This invention relates generally to an internal combustion engine and more particularly to a breather device of an engine in which a pressure chamber is disposed above the crank chamber.

2. Prior Art

In general, in a four-stroke-cycle engine, blow-bye gas filling the crank chamber is returned to the air suction system and caused to undergo recombustion. At the same time, the crank chamber is maintained at a negative pressure by the use of a breather device.

For example, there is disclosed in Japanese Utility Model Publication No. 41932/1986 a method which comprises conducting the blow-bye gas within the crank chamber into a pressure chamber (vacant chamber) provided above the crank chamber and then, after this blow-bye gas has pressed open a pressure-responsive valve (check valve) and flowed into a breather chamber, causing this blow-bye gas to recirculate into the air intake system thereby to undergo recombustion.

By the use of the breather device disclosed in this prior art, however, the oil content contained in the blow-bye gas in the crank chamber readily flows into the breather chamber, and an amply distinct gas/liquid separation effect cannot be obtained.

In another example as disclosed in Japanese Utility Model Laid-Open Publication No. 155616/1986, oil-blocking plates are parallelly affixed to the back surface or the entire surface of the pressure-responsive valve in order to attain gas/liquid separation. This method, however, has been accompanied by the problem of tendency of flowing of the oil content thus separated into the air intake system from the oil return passage because of spitting.

SUMMARY OF THE INVENTION

In view of the above described circumstances of the prior art, it is an object of this invention to provide a breather device of an engine by which ample gas/liquid separation can be obtained without spitting.

According to this invention there is provided a breather device of an engine, comprising a pressure chamber communicating with the crank chamber of the engine, an oil sump chamber communicating via a pressure-responsive valve with the pressure chamber, a breather chamber communicating via an oil holding wall with the oil sump chamber and communicating also with the engine air intake system, and oil return passage means having one end submerged in oil, the oil sump chamber being communicative with the oil return passage means.

When the pressure within the engine crank chamber becomes positive, the blow-bye gas is forced to flow into the pressure chamber of the breather device and then, forcing open the pressure-responsive valve, flows into the oil sump chamber. This gas then makes a detour over the oil holding wall to flow into the breather chamber, thereafter circulating into the engine air intake system. On the other hand, the oil content contained in the blow-bye gas is successively separated from the blow-bye gas in the pressure chamber, the pressure-responsive valve, and the oil sump chamber. Then, the oil portion collected in the oil sump chamber is circulated back through the oil return passage having one end submerged in oil into the crank chamber.

The nature, utility, and further features of this invention will be more clearly apparent from the following detailed description with respect to a preferred embodiment of the invention when read in conjunction with the accompanying drawings, briefly described below.

DETAILED DESCRIPTION OF THE INVENTION

Figure 1:
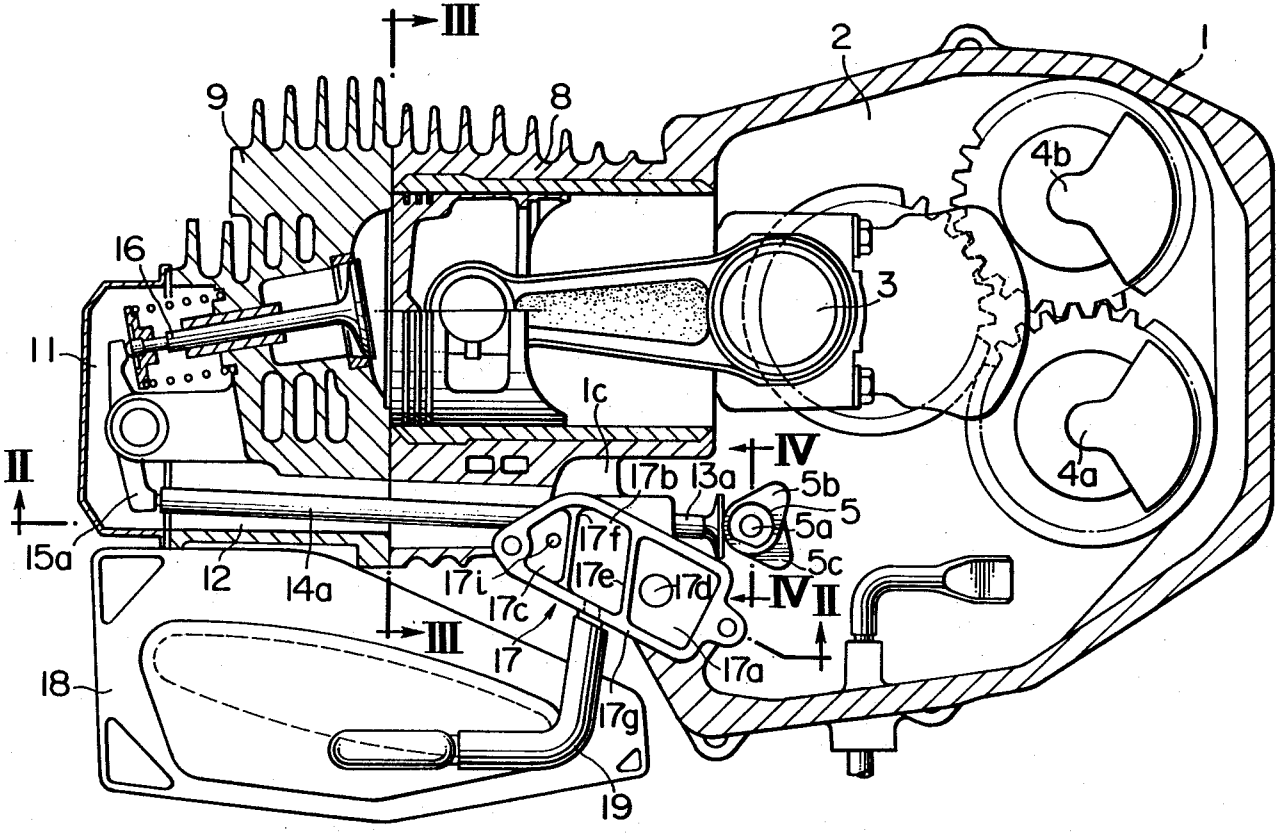
FIG. 1 is a horizontal section of a vertical-shaft engine provided with a breather device according to this invention.
Figure 2:
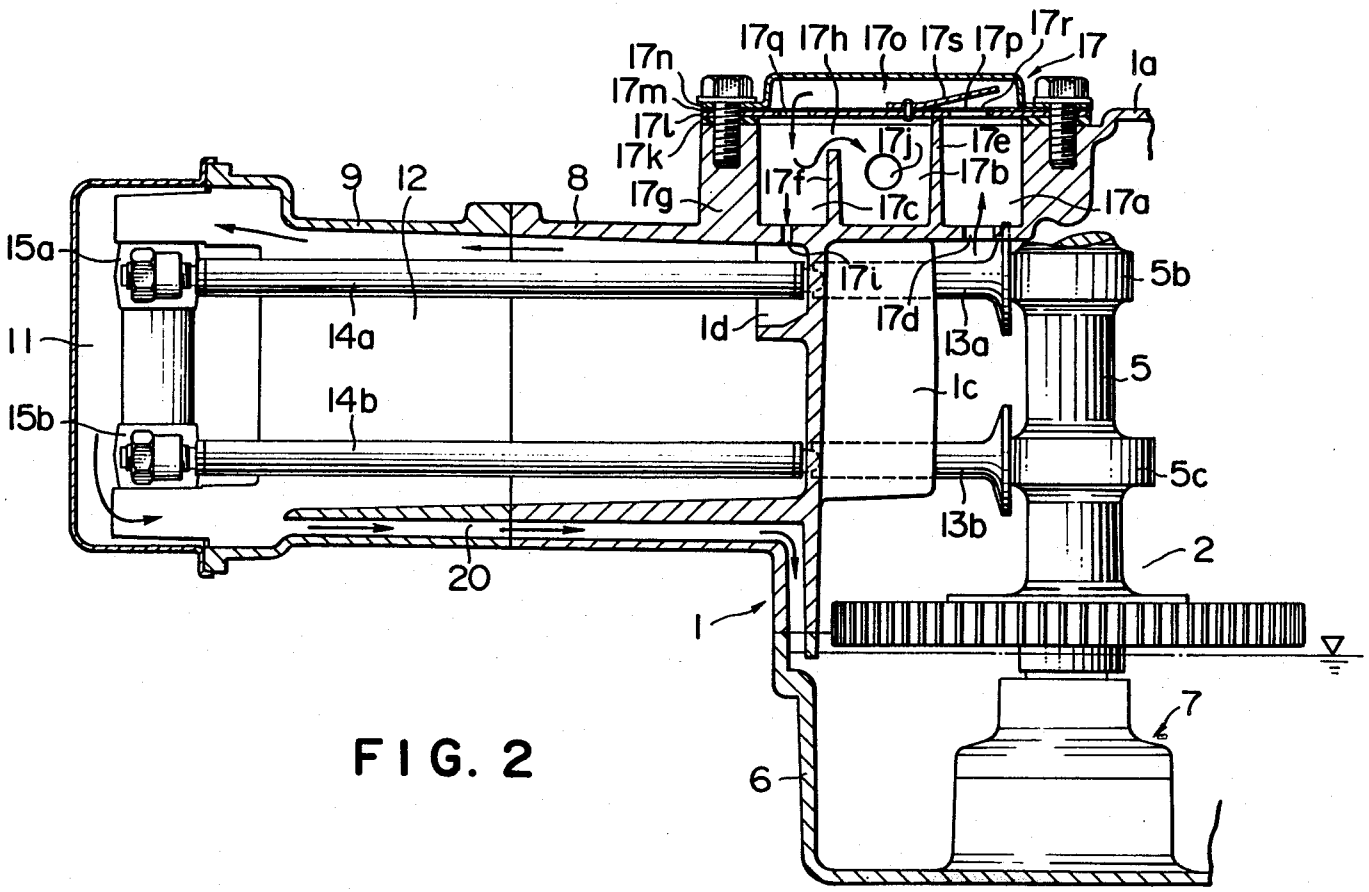
FIG. 2 is a vertical section, with parts cut away, taken along a vertical surface indicated by line II—II in FIG. 1 as viewed in the arrow direction.
Figure 3:
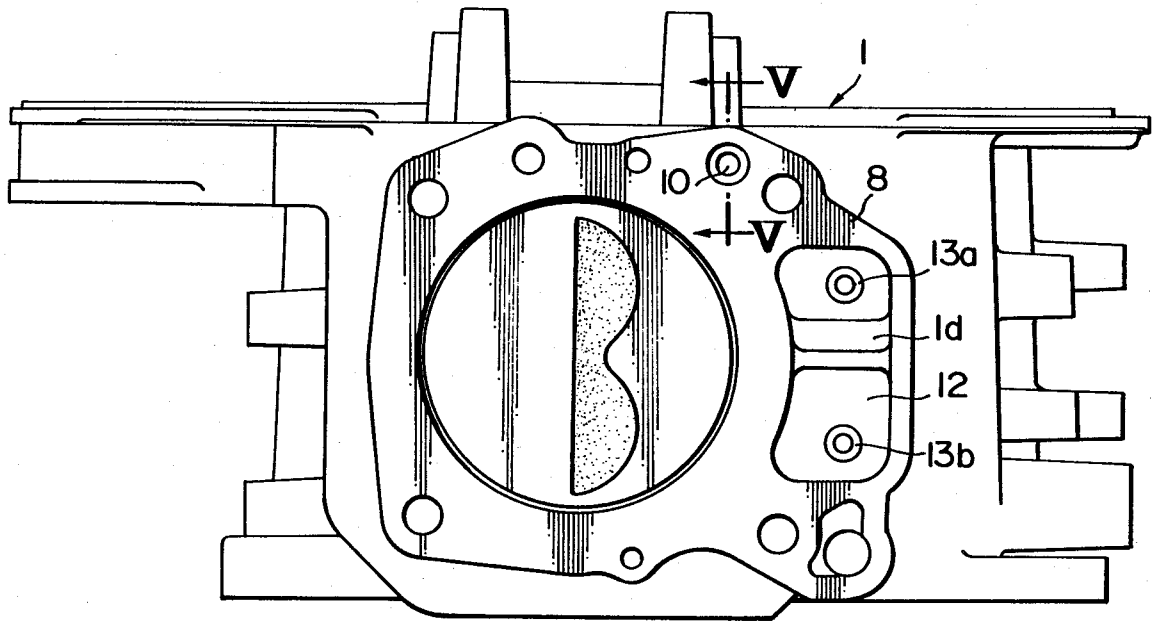
FIG. 3 is a vertical section taken along the vertical plane indicated by line III—III in FIG. 1 as viewed in the arrow direction.
Figure 4:
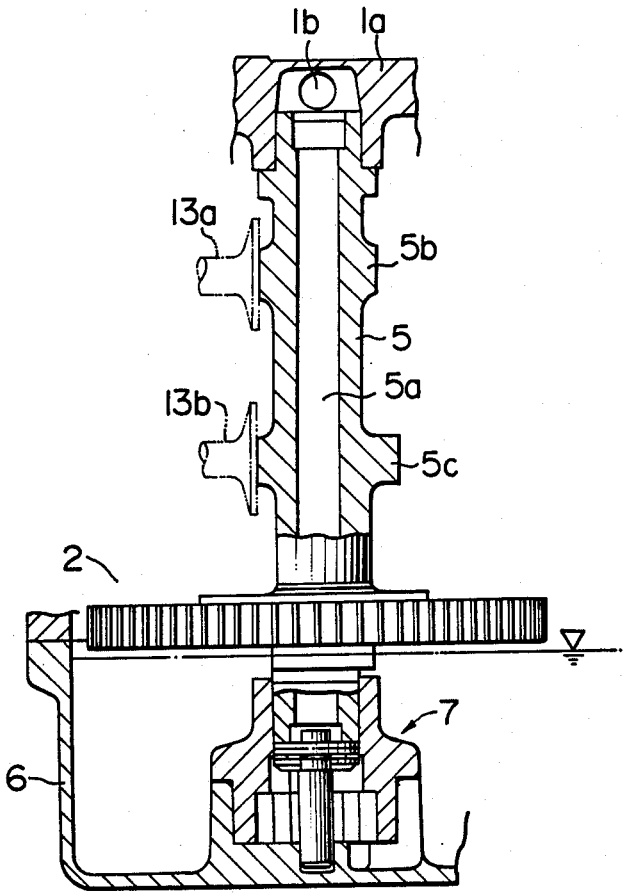
FIG. 4 is a partial vertical section taken along the vertical plane indicated by line IV—1V in FIG. 1 as viewed in the arrow direction.
Figure 5:
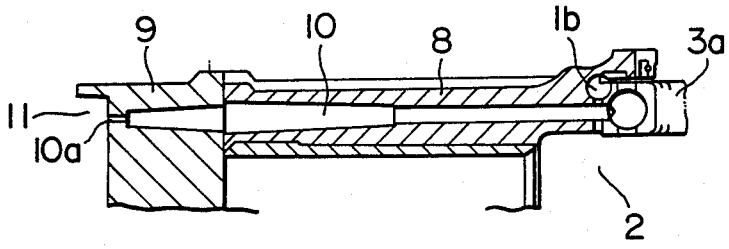
FIG. 5 is a partial vertical section taken along the vertical plane indicated by line V13 V in FIG. 3 as viewed in the arrow direction.

Referring to the drawings, the vertical-shaft engine shown therein has an engine main structure 1 the principal parts of which are a crankcase 1*a* including an oil pan 6, a cylinder block 8, and a cylinder head 9. The crankcase 1a has a crank chamber 2 accommodating a crankshaft 3, balancer shafts 4*a* and 4*b* for rotating in mutually opposite directions in intercoupled relationship with the crankshaft 3, a camshaft 5, and ancilary parts.

The lower end of this camshaft 5 is coupled to an oil pump 7 provided on the bottom of the oil pan 6. Through the interior of the camshaft 5 is formed an oil passage 5*a* communicating at its lower end to the oil pump 7. The upper part of this oil passage 5*a* communicates with a crank chamber lubrication passage 1*b* formed in the upper part of the crankcase 1*a* and opening communicatively at its one end into a main bearing 3*a* for supporting the crankshaft 3 and the cylinder inner wall. Furthermore, to this crank chamber lubrication passage 1*b* is connected as a branch a rocker chamber lubrication passage 10 formed through the cylinder block 8 and cylinder head 9 and having at its outer end a discharge port 10*a* opening into a rocker chamber 11.

When the camshaft 5 rotates, lubrication oil accumulated in the oil pan 6 is pumped by the oil pump 7 through the oil passage 5*a* in the camshaft 5 and, flowing through the crank chamber lubrication passage 1*b* and the rocker chamber lubrication passage 10, is supplied as lubricant into the crank chamber 2 and the rocker chamber 11.

Through one side wall of the cylinder block 8 and the cylinder head 9 is formed a push-rod chamber 12 communicating at its outer end with the rocker chamber 11. The inner end of this push-rod chamber 12 is separated from the crank chamber 2 by a partition wall 1*c*.

Through this partition wall 1*c* are slidably passed a pair of tappets 13*a* and 13*b* which thereby can undergo thrusting and retracting motion freely in their axial direction. The inner flanged ends of these tappets 13a and 13b are respectively in slidably abutting contact with cams 5b and 5c of the camshaft 5, while their outer ends are in abutting contact with the inner ends of a pair of push rods 14a and 14b inserted and extending parallelly through the push-rod chamber 12 to the rocker chamber 11. At the inner end wall of the push-rod chamber 12, that is, on the outer side of the partition wall 1c, is formed integrally therewith a guide wall 1d of concavely tapered form for guiding one of the push rods 14a and 14b to the corresponding tappet 13a or 13b at the time of assembly.

The outer ends of the push rods 14a and 14b project into the rocker chamber 11 and are coupled to the base or driven ends of rocker arms 15a and 15b which are pivotally supported at their middle parts in the rocker chamber 11. The other or driving ends of these rocker arms 15a and 15b are coupled to the valve stem ends of the intake or exhaust valve 16.

The engine is provided with a breather device 17 according to this invention, which has a casing structure 17g formed integrally with the crankcase 1a on its upper part adjoining the cylinder block 8. The interior of this casing structure 17g is divided into a pressure chamber 17a, a breather chamber 17b, and an oil sump chamber 17c, a partition wall 17e separating the pressure chamber 17a and the breather chamber 17b, and an oil holding wall 17f of weir form dividing the lower parts of the breather chamber 17b and the oil sump chamber 17c. All of the these three chambers 17a, 17b, and 17c are formed with open top parts.

The pressure chamber 17a is provided through its bottom with an inflow port 17d communicating with the crank chamber 2. The above mentioned oil holding wall 17f of weir form is open at its top, whereby a gas port 17h is formed and provides communication therethrough between the breather chamber 17b and the oil sump chamber 17c. Through the bottom of the oil sump chamber 17c is formed an oil return hole 17i communicating with the interior of the aforedescribed guide wall 1d provided at the inner end part of the push-rod chamber 12. A breather port 17j is formed through a side wall of the breather chamber 17b at substantially the middle part thereof and is communicatively connected by way of a breather pipe 19 to an air cleaner 18 which is upstream of and communicates with the air intake system of the engine.

Over the open top parts of the pressure chamber 17a, the breather chamber 17b, and the oil sump chamber 17c are fixedly clamped a packing 17k, a breather plate 17l, a packing 17m, and a breather cover 17n in that order from bottom to top. The breather cover 17n has a downwardly facing concavity which constitutes a valve chamber 17o. A vent hole 17p communicating the pressure chamber 17a and the valve chamber 17o is formed through the breather plate 17l. A communication hole 17q communicating the valve chamber 17o and the oil sump chamber 17c is also formed through the breather plate 17l.

A pressure-responsive valve, which in this example is a leaf valve 17r, is pressed against the upper surface of the breather plate 17l over the vent hole 17p. A bent plate 17s is fixed to the upper surface of the breather plate 17l to face the leaf valve 17r and restrict the opening angle thereof.

Through the cylinder block 8 and an inner part thereof is formed an oil return 20 which opens at its outer end into the rocker chamber 11 and at its inner open end is submerged in the lubricating oil accumulated in the oil pan 6. This oil return passage 20 and the oil return hole 17formed through the bottom of the oil sump chamber 17c of the breather device 17 are communicative through the push-rod chamber 12 and the rocker chamber 1.

The breather device according to this invention of the above described organization operates in the following manner in conjunction with the operation of the engine.

When the engine operates, the oil pump 7 coupled to the camshaft 5 rotates to pump the lubricating oil accumulated in the oil pan 6 up through the oil passage 5a formed axially through the camshaft 5. The oil is thus supplied under pressure through the crank chamber lubrication passage 1b formed through the upper part of the crankcase 1a and through the rocker chamber lubrication passage 10 connected the crank chamber lubrication passage 1b as a branch thereof.

The lubricating oil which has thus been sent through the rocker chamber lubrication passage 10 is ejected onto the inner wall surface of the cylinder and the upper part of the crank chamber 2. Separately, the lubricating oil which has been sent through the rocker chamber lubrication passage 10 is injected through the discharge port 10a of the passage 10 into the rocker chamber 11. Thus, the various parts of the engine requiring lubrication are lubricated by the lubrication oil injected in this manner through the oil passages 1b and 10.

The lubrication oil supplied into the rocker chamber 11 passes through the oil return passage 20 formed through the cylinder block 8 and the bottom part of the cylinder 9 and is circulated back to the oil pan 6.

In another aspect of the engine operation, the pressure within the crank chamber 2 undergoes fluctuations due to the reciprocating motion of the piston. When this pressure is position, the blow-bye gas filling this crank chamber 2 flows through the inflow port 17d into the pressure chamber 17a of the breather device 17 provided above the crank chamber 2 as described hereinbefore. Then, this blow-bye gas presses open the leaf valve 17r and, thus flowing into the valve chamber 17o, flows through the communication hole 17q into the oil sump chamber 17c.

Most of the oil contained in this blow-bye gas is separated out as the blow-bye gas passes through the inflow port 17d, as it impinges against the inner wall surface of the pressure chamber 17a, and as it collides with the leaf valve 17r. The oil content which has been thus separated as liquid droplets in the pressure chamber 17a is returned through the inflow port 17d into the crank chamber 2 when the pressure within the crank chamber 2 becomes negative.

The very small quantity of oil contained in the blow-bye gas passing through the valve chamber 17o, while flowing through the communication hole 17q, drops perpendicularly under the force of its inertial mass toward the bottom of the oil sump chamber 17c.

Since the mass of the blow-bye gas which flows downward through the communication hole 17q is small, this gas is caused by pressure difference to make a detour through the gas port 17h formed above the oil holding wall 17f and thereby to flow into the breather chamber 17b. As a result, this blow-bye gas thus flowing into the breather chamber 17b contains almost no oil, and only the blow-bye gas is sent through the breather port 17j opening into the breather chamber 17b and, by way of the breather pipe 19, to the air cleaner 18 thereby to undergo recombustion.

The oil content which has been separated as liquid droplets in the oil sump chamber 17*c* is blown by positive pressure in the crank chamber 2 through the oil return hole 17formed through the bottom of the oil sump chamber 17*c* into the push-rod chamber 12 and, passing through this push-rod chabmer 12, the rocker chamber 11, and then through the oil return passage 20 into the oil pan 6.

When the pressure within the crank chamber 2 becomes negative, the leaf valve 17*r* of the breather device 17 closes the vent hole 17*p* and thereby holds the crank chamber 2 in a negative pressure state. On the other hand, because of the enclosure of the vent hole 17*p*, the positive pressure within the rocker chamber 11 and the push-rod chamber 12 is maintained, and blowing back into the oil sump chamber 17*c* through the oil return hole 17communicating with the push-rod chabmer 12 cannot occur. Therefore, the oil collected in this oil sump chamber 17*c* cannot flow into the breather chamber 17*b*.

Furthermore, as described hereinbefore, the crank chamber 2 and the push-rod chamber 12 are separated by the partition wall 1c, and the breather device 17 is provided above the crank chamber 2. Therefore, even if the engine main structure 1 is tilted, the lubricating oil accumulated in the oil pan 6 cannot flow into the rocker chamber 11. Accordingly, even if the engine main structure 1 is tilted, the oil level is amply secured and assured, whereby a tilting of the engine cannot give rise to insufficient lubrication.

It is to be noted that this invention is not limited to the above described example thereof. For example, the oil sump chamber 17*c* of the breather device 17 may communicate directly with the oil return passage.

It will be apparent from the foregoing description that this invention provides a breather device having a pressure chamber communicating with the crank chamber, an oil sump chamber communicating via a pressure-responsive valve with this pressure chamber, and a breather chamber communicating via an oil holding wall with the oil sump chamber and also communicating with the engine air intake system, whereby an ample gas/liquid separation effect can be obtained.

Another advantageous feature of the breather device of this invention is that, since the above mentioned oil sump chamber is made communicative with an oil return passage one end of which is submerged in oil, blowing back to the oil sump chamber does not occur, and the gas/liquid separation performance is further improved.

What is claimed is:

1. A breather device of an engine having a crank chamber, a lubrication system including an oil pan holding lubrication oil, and an air intake system, said breather device comprising:

oil return passage means having a downstream end submerged in said lubrication oil in said oil pan;

an oil sump chamber communicating at a bottom part thereof with said oil return passage means;

a pressure chamber communicating with said crank chamber and provided with a pressure-responsive valve which is openable by a positive pressure within said pressure chamber to permit flow of fluid from said pressure chamber into said oil sump chamber; and a breather chamber which is communicative over an oil holding wall with said oil sump chamber and is communicating with said air intake system, whereby:

positive pressure in said crank chamber causes blow-bye gas therein to flow via said pressure chamber and said pressure-responsive valve into said oil sump chamber, then to detour over said holding wall into said breather chamber, and to flow into said air intake system, while lubricating oil initially contained in the blow-bye gas in the crank chamber is separated from the blow-bye gas successively in the pressure chamber, the pressure-responsive valve, and the oil sump chamber; and oil retained in the oil sump chamber is circulated back through the oil return means to the oil pan.

2. A breather device as claimed in claim 1 in which a part of said lubrication system of the engine serves doubly as a part of said oil return passage means.

* * * * *